US006814930B1

(12) United States Patent
Oldsberg et al.

(10) Patent No.: US 6,814,930 B1
(45) Date of Patent: Nov. 9, 2004

(54) GALVANIZED METAL CORROSION INHIBITOR

(76) Inventors: Michael T. Oldsberg, 1350 Cardinal La., Chaska, MN (US) 55318; Bruce D. Busch, 747 Vista Ridge La., Shakopee, MN (US) 55379

( * ) Notice: Subject to any disclaimer, the term of this patent is extended or adjusted under 35 U.S.C. 154(b) by 225 days.

(21) Appl. No.: 10/166,152

(22) Filed: Jun. 10, 2002

Related U.S. Application Data

(63) Continuation-in-part of application No. 09/335,622, filed on Jun. 18, 1999, now Pat. No. 6,468,470.

(51) Int. Cl.[7] ..... C23F 11/167

(52) U.S. Cl. ..... 422/15; 422/16; 422/17; 252/389.22; 252/389.23; 210/699

(58) Field of Search ..... 422/15, 16, 17; 252/389.22, 389.23; 210/699

(56) References Cited

U.S. PATENT DOCUMENTS

| | | | |
|---|---|---|---|
| 4,110,129 | A | 8/1978 | Matsushima et al. |
| 5,407,597 | A | 4/1995 | Busch et al. |
| 6,183,649 | B1 | 2/2001 | Fontana |

FOREIGN PATENT DOCUMENTS

| | | | |
|---|---|---|---|
| JP | 48-27936 | | 4/1973 |
| JP | 48071741 | A2 * | 9/1973 |
| JP | 06108274 | A * | 4/1994 |

* cited by examiner

*Primary Examiner*—Elizabeth McKane
(74) *Attorney, Agent, or Firm*—Haugen Law Firm PLLP

(57) ABSTRACT

A white rust inhibiting composition and method of inhibiting white rust for evaporative water coolers are disclosed. The composition includes, in combination, a blend of one or more organophosphorus compounds and one or more tannin compounds.

8 Claims, No Drawings

GALVANIZED METAL CORROSION INHIBITOR

CROSS-REFERENCE TO RELATED APPLICATION

The present application is a continuation-in-part of application Ser. No. 09/335,622, filed Jun. 18, 1999, now U.S. Pat. No. 6,468,470 entitled "GALVANIZED METAL CORROSION INHIBITOR", the contents of which are herein incorporated by reference.

BACKGROUND OF THE INVENTION

The present invention relates generally to improved formulations for the treatment of open-type evaporative cooling water systems, and more specifically to corrosion inhibiting formulations stable in the presence of strong and highly effective oxidizing microbiocides. These formulations retain their corrosion inhibiting properties for metals having zinc-based surface coatings thereon even when in admixture with oxidizing microbiocides.

Zinc based coatings are commonly employed on surfaces of ferrous metals to create galvanized sheet metal for use in manufacturing components used in open evaporative cooling systems. The well known galvanized metals are a primary example of such zinc based sacrificial coatings.

While stable in the presence of an oxidizing microbiocide, the materials utilized in formulating the present invention are environmentally friendly, and do not lose their effectiveness against the ever present formation or generation of white rust deposit.

Open evaporative cooling water circulation systems which are commonly employed in large industrial or commercial installations require large amounts of cooling water. In the operation of evaporative systems utilizing cooling water, quantities of the water are continually evaporating and lost to the atmosphere, thus creating a need for additional amounts of make-up water to be added at a rate dependent upon the immediate service requirements of the installation. As introduced, make-up water commonly contains a number of impurities and/or contaminants including dissolved gases, dissolved chemical compounds and suspended particulates. Normal operation of these cooling systems results in the consumption of reasonably large quantities of water, primarily through evaporation and this results in a buildup of these contaminants or impurities, which in turn leads to elevated levels or concentrations of these contaminants. Of particular concern is the elevation or increase of carbonate alkalinity and the associated increase in pH levels.

This increase in carbonate alkalinity often results in corrosion of components or parts in the evaporative system, with the zinc based or galvanized coatings present in the systems being highly susceptible. Evidence of corrosion in these coatings typically appears visually as a white, waxy, adherent deposit on the surfaces of the components. This corrosive mechanism or syndrome is commonly referred to as "White Rust" by those in the water treatment industries. White rust has been identified as the product of a corrosive mechanism involving metallic zinc and carbonate ions with the reaction normally resulting in the formation of the compound $ZnCO_3.3Zn(OH)_2.H_2O$. White rust corrosion may quickly result in the loss of corrosion inhibition or protection of the ferrous metal substrate due to deterioration or loss of a portion of the zinc coating. If left unchecked, rapid anodic corrosion of zinc coated parts may occur, leading to the premature failure of components present in the cooling system.

There are presently several current methods that have been employed or proposed for the prevention of white rust corrosion; they include the following:

(A) The addition of a sufficient quantity of an acid, most commonly sulfuric acid, to the cooling water in order to adjust the pH downwardly and prevent the creation of or greatly reduce the concentration of carbonate ions in the cooling water. This has been suggested as a way to preclude the formation of zinc carbonate and thereby prevent or inhibit white rust corrosion. The addition of an acid feed to cooling water systems, however, poses safety hazards to those personnel responsible for handling the acid or working with the system, and also has the potential of contributing to aggressive corrosion of metallic parts in the event of an overfeed of acid to the system.

(B) Another approach which has proven capable of reducing or preventing white rust corrosion is the addition of amounts of orthophosphate and/or zinc chemical compounds to the cooling water in order to provide a zinc-orthophosphate film. In such systems, both the orthophosphate and zinc compounds are generally present in quantities of 20 to 100 mg/l as $PO_4$ and as Zn. The phosphate and zinc-phosphate treatments are effective as short-term treatments to provide corrosion protection by forming passivating films on metallic surfaces.

In certain applications, the effectiveness of this approach to protection may be short-lived. Due to the rapid degradation of the protective or passivating film, degradation of the film must be followed by a re-passivation step to prevent localized white rust corrosion. The formation of these passivating films is dependent upon a number of other influencing parameters including features of the cooling equipment being employed and/or the water treatments being utilized. Thus, the quality and longevity of the passivating films remain as either uncertain or indeterminable variables and the systems must be continually monitored for detection of film failure and white rust formation.

Additional disadvantages of such passivating treatments include the possible formation of undesired films or deposits on heat transfer surfaces resulting in decreased equipment efficiency. Concerns for regulatory measures relative to the cooling water disposal are ever present. Potential also exists for damage to the passivating film by oxidizing biocide treatments, by over feed of acidic pH control chemicals and/or by physical erosion.

The use of hard make-up water (water containing ions which contribute to hardness, i.e., calcium and magnesium ions), is recommended in conjunction with a number of current film-forming methods for white rust control. Many of the film-forming corrosion inhibitors which are typically utilized at present require the incorporation of calcium ions. Calcium ions in the cooling water are believed to compete with zinc from the zinc coatings for the carbonate ions, thereby reducing the formation of zinc carbonate.

However, delivering hard water feed to cooling systems is disadvantageous in those instances where the available make-up water contains only modest quantities or no dissolved calcium at all. It is also disadvantageous in those instances where make-up water has been softened in order to prevent or reduce the undesirable calcium carbonate scale formation on heat transfer surfaces.

It will be appreciated that a benign approach to the reduction of white rust corrosion in galvanized or zinc-based coatings capable of circumventing known disadvantages of previous techniques would be a welcome solution to this longstanding problem associated with water cooling systems. This is especially true for a cooling water treatment that would be compatible with the existing water conditions (i.e., relatively high pH and alkalinity and relatively low hardness). Of particular added interest is the utilization of a white rust corrosion inhibitor which is stable in the presence of oxidizing microbiocides such as the commonly utilized bromine, chlorine, ozone, and similar compounds.

Galvanized metal corrosion inhibitor formulations as set forth in U.S. Pat. No. 5,407,597 entitled "Galvanized Metal Corrosion Inhibitor", assigned to the same assignee as the present application, are effective in the prevention of white rust corrosion of galvanized steel surfaces of recirculating evaporative cooling systems operating with cooling water of alkaline pH, and do not require the use of acid to adjust the cooling water pH nor pre-passivation of galvanized metal surfaces as described above.

The inhibitor formulations commonly utilized, including those set forth in U.S. Pat. No. 5,407,597 have been found in practice to be somewhat unstable or incompatible with oxidizing microbiocides commonly used for the prevention of microbiological fouling by algae, bacteria and fungi. The use of oxidizing microbiocides is an integral component of any effective microbiological control program. The prevention of growth of explosive populations of microbes is imperative in controlling: (a) organic fouling or buildup within the system which leads to a reduction in the heat transfer efficiency of the cooling tower system; (b) microbiologically induced corrosion of cooling tower components which reduces the effective life of the cooling tower system; and (c) the potential distribution or spread of disease through human contact with cooling tower water or mist (including such dangerous maladies as Pontiac Fever and Legionnaires Disease). It is therefore, apparent that compatibility and stability of cooling tower inhibitor formulations with oxidizing microbiocides is highly advantageous in the practical treatment of cooling tower systems.

SUMMARY OF THE INVENTION

Accordingly, it is a primary object of the present invention to provide cooling water treatment formulations which are capable of preventing or significantly reducing white rust corrosion of zinc coatings utilized in evaporative cooling water systems thereby providing a mechanism for extending the useful life of that equipment.

It is another object of the invention to provide a cooling water treatment system capable of preventing or significantly reducing white rust corrosion of zinc-based coatings present on components used in open evaporative cooling water systems in order to avoid the reduction in efficiency or other limitations created when acidic additives are introduced to the feed water supply.

A further object of the present invention is to provide corrosion inhibiting formulations which are stable in the presence of oxidizing microbiocides and yet are effective in the prevention of white rust corrosion of zinc coatings in cooling systems using water with elevated carbonate alkalinity and pH values, thereby eliminating the need for the addition of a neutralizing acid feed to the water.

A still further object of the present invention is to provide formulations stable in oxidizing microbiocide formulations, and yet effective in the prevention of white rust corrosion of zinc coatings in evaporative cooling water systems employing soft water essentially free of calcium or magnesium ions.

Yet another object of the invention is to provide formulations for inhibitors which are both stable in the presence of oxidizing microbiocides and effective in the prevention of white rust corrosion of zinc coatings in cooling water systems with the chemicals comprising the formulation neither contributing to buildup of scale, creation of deposits, nor corrosion of the evaporative cooling water system when utilized at residuals necessary to provide effective white rust control.

It is yet a further object of the present invention to provide formulations effective in preparing stable working solutions for prevention of white rust corrosion of galvanized or zinc coatings, with solutions from these formulations being compatible with other chemical components typically utilized in cooling water systems for controlling scale and for reducing deposition, inhibiting corrosion and inhibiting microbiological fouling.

It is a still further object of the present invention to provide formulations which are both stable in the presence of oxidizing microbiocides and effective in the prevention and inhibition of white rust corrosion of zinc coatings, while further being effective in inhibiting scale buildup and metallic corrosion, and particularly that of copper corrosion.

Other and further objects of the present invention will become apparent to those skilled in the art upon a study of the following specification and appended claims.

DESCRIPTION OF THE PREFERRED EMBODIMENT

The present invention provides multi-components stable formulations capable of preventing or significantly reducing white rust corrosion of zinc-based coatings normally used on components in open evaporative cooling water systems and with the formulations avoiding imposition of added limitations and/or disadvantages associated with currently utilized and/or proposed techniques.

The formulations of the present invention may be fed or introduced to the cooling water system either as adjunct treatments utilized in combination with scale, deposition and corrosion inhibiting formulations or incorporated as components in "multi-purpose" systems or formulations. The formulations are ready for use in aqueous solution or suspensions, or alternatively, may be used as blends in substantially dry or crystalline condition., Since combinations of the present invention are compatible with typical pH ranges for cooling water and since they function without regard to the presence of hardness ions, they may be used freely with other cooling water treatments. Indeed, the formulations of the present invention are useful over wide ranges of pH, ranging on the alkaline side as high as about 9.5 and as low as about 7. Additionally, they are useful in cooling water containing the commonly encountered impurities. The formulations of the present invention may advantageously be fed or injected on a continuous basis thereby providing continuing re-passivation of zinc coating surfaces in the event the passive film provided by the present invention becomes ineffective or impaired by any means. In one embodiment of the present invention, the water treatment composition of the present invention employs a synergistic blend of one or more organophosphorus compounds with one or more tannin compounds along with one or more soluble metal compounds. In another embodiment of the present invention, the water treatment composition of the present invention employs a synergistic blend of one or more organophosphorus compounds with one or more tannin compounds.

Organophosphorus compounds suitable for use in the present invention include compounds selected from the group including 1-hydroxyethylidene-1,1-diphosphonic acid; aminotris methylenephosphonic acid; 2-phosphonobutane-1,2,4-tricarboxylic acid; 1,2-diaminocyclohexane tetrakis-(methylene-phosphonic acid); phosphono carboxylic acid polymers; 2-methylpentane diamine tetrakis-(methylene-phosphonic acid); phosphono-hydroxyacetic acid and other organophosphorus compounds of comparable properties.

The tannin compounds utilized in the present invention include tannic acids, tannin compounds selected from both the condensed and hydrolyzable tannin groups, and other known gallic acid derivatives exhibiting comparable properties.

The metal compounds utilized in some embodiments of the present invention include the water soluble salts of metals selected from molybdenum; titanium; tungsten; and vanadium; and others of similar properties.

The components of the combination of the invention are generally known individually to possess certain desirable properties applicable to aspects of cooling tower water treatment not relating to white rust prevention. In this manner, certain of the organophosphorus compounds employed alone have found favor in the treatment of open evaporative cooling systems as scale and deposit preventatives and modifiers as well as corrosion inhibitors for ferrous metals. Some of the tannin compounds have been shown to be useful in the treatment of cooling systems, functioning as dispersants and/or corrosion inhibitors.

The combined effect of the multi-component system of the invention together with the stability exhibited in the presence of oxidizing microbiocides has been discovered to be far more effective than could have been predicted. This will become apparent from the examples detailed below.

Experiments were performed utilizing a simulated cooling system test rig which enabled the control of pH, recirculation rate, water volume and water temperature parameters. The raw material ingredients as listed were tested alone and in combinations with each other at concentrations in the cooling water between 1 and 100 mg/l as active ingredient.

None of the ingredients listed when tested alone was found to effectively control white rust corrosion. A combination of ingredients, as presented in Example I below, were found to inhibit white rust corrosion on galvanized steel panels at greater than 95% inhibition in test rig conditions including hard and soft test waters with pH values held from 7.5 to 10.0.

EXAMPLE I

| Ingredient | Test Concentration in Cooling Water |
|---|---|
| Sodium molybdate, dihydrate ($Na_2MoO_4.2H_2O$) | 10 mg/l as Mo (1 part) |
| 2-phosphonobutane-1,2,4-tricarboxylic acid $C_7H_{11}O_9P$ 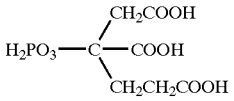 | 20 mg/l as active ingredient (2 parts) |
| Phosphono carboxylic acid | 20 mg/l as active |

-continued

| Ingredient | Test Concentration in Cooling Water |
|---|---|
| polymer 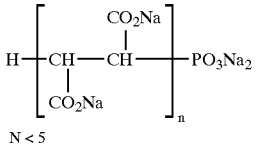 N < 5 wherein "n" is an integer having a value of up to 5, | ingredient (2 parts) |
| Tannic acid ($C_{76}H_{52}O_{46}$) | 15 mg/l as active ingredient (1.5 parts). |

Table I, below, represents a tabulation of test data obtained with respect to white rust inhibition utilizing components of the combination of ingredients of Example I.

TABLE I

| Treatment Utilized | Concentration Employed (Active) | g/sq.ft./year Corrosion rate | Galvanized Coating Failure (as % surface area failed) |
|---|---|---|---|
| None (control) | 65 mg/l | 331.8 | 85 |
| Sodium molybdate dihydrate | 65 mg/l | 198.6 | 55 |
| 2-phosphono-butane-1,2,4-tricarboxylic acid | 65 mg/l | 170.6 | 90 |
| Phosphono carboxylic acid polymer | 65 mg/l | 120.1 | 80 |
| Tannic acid | 65 mg/l | 20.4 | 20 |
| Example 1 combination | 65 mg/l | 9.1 | 0 |

Test Conditions:
pH=9.5 (maintained with sodium carbonate additions)
Cooling water temperature: 80° F.
Cooling water hardness level: 0 mg/l as total hardness
Test duration: 150 hours.

Pre-weighed, galvanized (G-70) panels were immersed in the cooling test rig employing the above test conditions. All panels tested were cleaned by the immersion in a solution of 30% ammonium hydroxide and 1% ammonium dichromate in distilled water in order to remove all white rust corrosion from the panels. All panels were re-weighed following cleaning. Weight loss of panels was recorded.

All test panels, with the exception of those panels treated with the combination formula described in Example I, revealed failure of the galvanized coating to the extent listed in Table I. This failure was visibly perceptible, as the loss of spangled galvanized coating and the revelation of the steel substrate, following the cleaning of the panels. Tests of greater durations utilizing G-70 panels were found to result in the continued failure of the galvanized coating until, ultimately, total galvanized coating failure was observed.

The test panels treated with the combination formula of Example I revealed no failure of the galvanized surface. Extended duration testing revealed only a negligible increase in weight loss as a function of time. The corrosion rate (as weight loss in grams/square foot/year) of panels treated with the combination formula of Example I was, therefore, found to significantly decrease as the time duration of the tests increased. None of the extended duration test panels treated with the combination formula of Example I revealed failure of the galvanized coating. It is theorized that the relatively low (baseline) weight loss of those panels treated with Example I is the result of the reaction of the combination formula of Example I with the galvanized coating of the panel in the formulation of an inhibitor film.

The data tabulated above clearly illustrates the dramatic effect of the ingredient combination represented by Example I with respect to the inhibition of white rust corrosion of G-70 galvanized steel panels subjected to simulated cooling water conditions.

In addition to the formulation of Example I, in order to best disclose the properties of typical preferred formulas, the following specific examples of successful formulas are also provided:

EXAMPLE II

| Ingredient | Percent by Weight |
|---|---|
| Sodium molybdate, dihydrate ($Na_2MoO.H_2O$) | 6.25% (~2.5% Active Mo) |
| 2-phosphonobutane-1,2,4-tricarboxylic acid | 5.00% |
| Phosphono carboxylic acid polymer | 5.00% |
| Tannic acid | 3.75% |
| Water | balance. |

The above formulation has been prepared in a stainless steel or glass lined vessel equipped with a cooling jacket. Water was added to the vessel and the cooling jacket was employed. Tannic acid powder was added to the vessel with agitation provided until the tannic acid dissolved. The 2-phosphonobutane-1,2,4-tricarboxylic acid, phosphono carboxylic acid polymer and sodium molybdate, dihydrate ingredients were added slowly, with agitation in the order listed.

The formula of Example II is illustrated as an aqueous solution, but can be rendered in and used in a dry state as well. In this regard, the above listed percentage composition of the ingredients, of course, will change but the ratio of active ingredients should remain essentially the same.

While the above represents a particularly successful proven combination of the class discovered to be effective, it is presented by way of example and not limitation as other compositions fall clearly within the scope of the invention.

The material may be added continually to the cooling system as with make-up water or intermittently as indicated.

Experiments were performed utilizing the simulated cooling system test rig previously described in order to assess the compatibility of formulations of the present invention with oxidizing microbiocides.

The inhibitor formulation as set forth in U.S. Pat. No. 5,407,597 and illustrated in Example III below has been found to be effective in the prevention of white rust corrosion of galvanized steel surfaces. The corrosion inhibiting properties of this formulation have been found in practice to be compromised by the presence of oxidizing microbiocides.

EXAMPLE III

| Ingredient | Percent by Weight |
|---|---|
| Sodium molybdate, dihydrate ($Na_2MoO_4.2H_2O$) | 6.25% (~2.5% Active Mo) |
| 2-phosphonobutane-1,2,4-tricarboxylic acid | 5.00% |
| Phosphono hydroxyacetic acid | 5.00% |
| Sodium diethyldithio-carbamate | 2.50% |
| Sodium hydroxide | 10.00% |
| Water | balance. |

Comparative testing of the present invention as described in Example II and the previous art as described in Example III was performed using the test method described below.

TEST METHOD

Pre-weighed, galvanized (G-70) panels were immersed in cooling test rigs employing the test conditions described in Table II. The galvanized panels were examined following 72 hours of immersion in the test rigs. No visible evidence of white rust corrosion was detected on any of the panels immersed in either of the test formulations of Examples II and III. At 72 hours immersion duration, a granular mixture of sodium bromide and sodium hypochlorite was added to the test rigs to achieve a 1.0 ppm free halogen residual (as ppm free chlorine). The galvanized panels were subjected to an additional 150 hours immersion, during which time the free halogen residual was maintained at 1.0 ppm as free chlorine by means of additions of the granular bromide/hypochlorite mixture. At 222 hours immersion duration, the panels were removed from the test rigs, cleaned as previously described, and re-weighed. Weight loss of panels was recorded and used to calculate the corrosion rate data recorded in Table II.

Table II, below, represents a tabulation of test data obtained in the halogen stability experiments described above.

TABLE II

| Treatment Utilized | Concentration Employed (Active) | g/sq.ft./year Corrosion Rate | Galvanized Coating Failure (as % surface area failed) |
|---|---|---|---|
| Example II | 175 ppm | 16.4 | 0 |
| Example III | 175 ppm | 99.3 | 32 |

Test Conditions:

pH=9.5 (maintained with sodium carbonate additions)
Cooling water temperature: 80° F.
Cooling water hardness level: 0 mg/l as total hardness
Test duration: 72 hours without oxidizing microbiocide addition;
150 hours with 1.0 ppm total halogen (as ppm free chlorine);
222 hours total test duration.

The data tabulated above clearly illustrate an improved stability in the presence of oxidizing microbiocide compounds of the present invention with respect to the prior art.

In another embodiment of the composition of the present invention, one or more organophosphorous compounds are combined with one or more tannin compounds in synergistic effective amounts. Compositions utilizing such synergistic effective amounts of one or more organophosphorous compounds and one or more tannin compounds have been found to be effective in inhibiting and preventing white rust corrosion of galvanized steel components in open evaporative cooling systems. In preferred embodiments, the composition includes from about 3.5% to about 28.5% by weight active organophosphorous material, and from about 0.9–7.5% by weight active tannin material, with balance water.

A specific example of a formula successful in preventing or inhibiting white rust corrosion is as follows:

EXAMPLE IV

| Ingredient | Percent by Weight |
|---|---|
| 2-phosphonobutane-1,2,4-tricarboxylic acid | 5.00% |
| Phosphonocarboxylic acid polymer | 7.50% |
| 1-hydroxyethylidene-1,1-diphosphonic acid | 1.66% |
| Tannic acid | 3.75% |
| Water | balance. |

The above formulation is most effective when applied to maintain a concentration of between 200 and 500 parts per million product in the cooling water. The above formulation is exemplary, in that various organophosphorous compounds and tannin compounds may be utilized in the preferred composition ranges referred to above.

In an additional embodiment of the present invention, additional components may be added to the above compositions set forth in Example IV for remedying other deleterious effects on cooling water systems caused by supply water. Such deleterious effects include, but are not limited to, scaling and metallic corrosion other than through white rust of zinc coating. By adding such additional components, a "multi-purpose" corrosion inhibiting material is formed for beneficial use in evaporative cooling systems.

In particular embodiments of the present invention, scale-inhibiting components are added at a concentration of from about 1% to about 10% by weight of the overall composition. A variety of scale-inhibiting compounds are useful in the present invention. Examples of such scale-inhibiting materials include acrylate polymers, copolymers, terpolymers, or combinations thereof. In addition, maleic acids, and particularly polymaleic acid are further useful as a scale-inhibiting component.

Metallic corrosion inhibiting agents are also useful in the multi-purpose composition of the present invention. It is particularly useful to inhibit copper corrosion in evaporative cooling systems for protecting fittings, weld spots, pipes, and any other parts fabricated from copper. Many triazoles are effective in inhibiting such copper corrosion, and particularly benzotriazoles including sodium benzotriazole.

A preferred embodiment of such a multi-purpose composition incorporating scale and metallic corrosion inhibiting agents is illustrated in the following example:

EXAMPLE V

| Ingredient | Percent by Weight |
|---|---|
| 2-phosphonobutane-1,2,4-tricarboxylic acid | 5.00% |
| Phosphonocarboxylic acid polymer | 7.50% |
| 1-hydroxyethylidene-1,1-diphosphonic acid | 1.66% |
| Polymaleic acid | 2.50% |
| Acrylate copolymer | 2.50% |
| Tannic acid | 3.75% |
| Sodium benzotriazole | 0.63% |
| Water | balance. |

The components and concentrations listed above are for exemplary purposes only, and it is to be understood that a variety of scale and metallic corrosion inhibiting agents may be substituted therefor within the approximate concentration ranges listed above.

What is claimed is:

1. A water soluble white rust inhibiting composition for treating zinc coatings in alkaline cooling water and evaporative water cooling systems by addition to the cooling water contained consisting essentially of:

| Ingredient | Percent by Weight |
|---|---|
| Organophosphorous compounds | 3.5–28.5% |
| Tannin compounds | 0.9–7.5% |
| Water | balance. |

2. A composition as in claim 1 wherein said organophosphorous compounds are selected from the group consisting of 1-hydroxyethylidene-1,1-disphosphonic acid; aminotris methylerie phosphonic acid; 2-phosphonobutane-1,2,4-tricarboxylic acid; 1,2-diaminocyclohexane tetrakis-(methylene-phosphonic acid); phosphono carboxylic acid polymers; 2-methylpentane diamine tetrakis-(methylene-phosphonic acid); and phosphonohydroxyacetic acid, and wherein said tannin compounds are selected from the group consisting of condensed tannin groups, hydrolyzable tannin groups, tannic acid, and gallic acid.

3. A water soluble white rust inhibiting composition consisting essentially of:

| Ingredient | Percent by Weight |
|---|---|
| 2-phosphonobutane-1,2,4-tricarboxylic acid | 5.00% |
| Phosphonocarboxylic acid polymer | 7.50% |
| 1-hydroxyethylidene-1,1-diphosphonic acid | 1.66% |
| Tannic acid | 3.75% |
| Water | balance. |

4. A water soluble composition for treating cooling water in evaporative water cooling systems consisting essentially of:

| Ingredient | Percent by Weight |
|---|---|
| 2-phosphonobutane-1,2,4-tricarboxylic | 1.25–10% |
| Phosphonocarboxylic acid polymer | 1.5–15% |
| 1-hydroxyethylidene-1,1-diphosphonic acid | 0.4–3.5% |
| Polymaleic acid | 0.6–5% |
| Acrylate copolymer | 0.6–5% |
| Tannic acid | 0.9–7.5% |
| Sodium benzotriazole | 0.15–1.5% |
| Water | balance. |

5. A water soluble composition as in claim 4 consisting essentially of:

| Ingredient | Percent by Weight |
|---|---|
| 2-phosphonobutane-1,2,4-bricarboxylic acid | 5.00% |
| Phosphonocarboxylic acid polymer | 7.50% |
| 1-hydroxyethylidene-1,1-diphosphonic acid | 1.66% |
| Polymaleic acid | 2.50% |
| Acrylate copolymer | 2.50% |
| Tannic acid | 3.75% |
| Sodium benzotriazole | 0.63% |
| Water | balance. |

6. A method for inhibiting white rust corrosion of galvanized steel surfaces of recirculating evaporative water cooling systems containing an oxidizing microbiocide comprising the step of adding to the cooling water a water soluble inhibitor composition containing;

(a) one or more organophosphorous compounds selected from the group consisting of 1-hydroxyethylidene-1,1-disphosphonic acid; aminotris methylene phosphonic acid; 2-phosphonobutane-1,2,4-tricarboxylic acid; 1,2-diaminocyclohexane tetrakis-(methylene-phosphonic acid);

phosphono carboxylic acid polymers; 2-methylpentane diamine tetrakis-(methylene-phosphonic acid); and phosphonohydroxyacetic acid; and (b) one or more tannin compounds selected from the group consisting of condensed tannin groups, hydrolyzable tannin groups, tannic acid, and gallic acid;

(c) wherein said inhibitor composition consists essentially of the following formula:

| Ingredient | Percent by Weight |
|---|---|
| 2-phosphonobutane-1,2,4,-tricarboxylic acid | 5.00% |
| Phosphonocarboxylic acid polymer | 7.50% |
| 1-hydroethylidene-1,1-diphosphonic acid | 1.66% |
| Tannic acid | 3.75% |
| Water | balance. |

7. A method as in claim 6 wherein the inhibitor composition is added in a dried crystalline form.

8. A method as in claim 6, further comprising the step of maintaining the concentration of said inhibitor composition in said cooling water at an effective corrosion inhibiting level of up to approximately 500 ppm.

* * * * *